US008443471B2

(12) United States Patent
McCurdy

(10) Patent No.: US 8,443,471 B2
(45) Date of Patent: May 21, 2013

(54) ROPE AND FASTENER ASSEMBLY

(76) Inventor: James R. McCurdy, Atlanta, GA (US)

( * ) Notice: Subject to any disclaimer, the term of this patent is extended or adjusted under 35 U.S.C. 154(b) by 0 days.

(21) Appl. No.: 13/231,501

(22) Filed: Sep. 13, 2011

(65) Prior Publication Data

US 2012/0060278 A1 Mar. 15, 2012

Related U.S. Application Data

(60) Provisional application No. 61/382,288, filed on Sep. 13, 2010.

(51) Int. Cl.
*A47C 3/22* (2006.01)
*B23P 17/04* (2006.01)

(52) U.S. Cl.
USPC ..... 5/120; 5/122; 87/7

(58) Field of Classification Search
USPC ..... 5/120, 122, 123, 127–130, 98.3; 294/150, 294/152, 153, 156, 103, 250; 24/265 R, 265 EE, 24/16 R, 18, 17 A, 298, 302; 289/18.1, 1.2, 289/1.5, 16.5; 182/190, 196, 199; 297/273; 248/230.1, 230.8, 230.9; 119/769, 792; 410/96, 410/97; 54/24, 34; 47/67; 87/7, 8; 29/461
See application file for complete search history.

(56) References Cited

U.S. PATENT DOCUMENTS

| | | | | | |
|---|---|---|---|---|---|
| 803,091 | A * | 10/1905 | Brayshaw | 5/122 |
| 852,180 | A * | 4/1907 | Hoffman | 24/72.5 |
| 1,580,553 | A * | 4/1926 | Brenny | 54/24 |
| 3,606,621 | A * | 9/1971 | Bertsche | 5/122 |
| 3,718,947 | A * | 3/1973 | Huber | 24/298 |
| 4,405,034 | A * | 9/1983 | Dunne | 182/190 |
| 4,885,824 | A * | 12/1989 | Schwab et al. | 24/17 B |
| 5,293,657 | A * | 3/1994 | DeAth | 5/127 |
| 5,579,548 | A * | 12/1996 | Death | 5/127 |
| 5,662,295 | A * | 9/1997 | Nadherny et al. | 248/58 |
| 6,421,851 | B2 * | 7/2002 | Hennessy | 5/120 |
| 2009/0049654 | A1 * | 2/2009 | Iosue | 24/115 R |
| 2011/0154797 | A1 * | 6/2011 | Dahl | 57/200 |

OTHER PUBLICATIONS

Scoutcraft "The Commado Rope", publication date of Nov. 9, 2004, located at http://members.aol.com/troop632/trailhead/toggle.htm.*

* cited by examiner

*Primary Examiner* — Michael Trettel
(74) *Attorney, Agent, or Firm* — Scott E. Brient; Bryan D. Stewart

(57) ABSTRACT

A rope assembly, according to various embodiments, comprises: (1) a braided rope comprising a plurality of braided strands; and (2) a rope fastener that is adapted to: (A) be attached to the braided rope adjacent a first end of the braided rope; (B) allow a user to selectively form a braided rope loop of a first particular circumference by fitting the rope fastener through the plurality of braided strands at a first particular location on the braided rope; and (C) allow a user to selectively form a braided rope loop of a second particular circumference by fitting the rope fastener through the plurality of braided strands at a second particular location on the braided rope. In various embodiments, the rope fastener is shaped for selectively preventing the rope fastener from returning through the plurality of braided strands after the rope fastener has been fitted through the plurality of braided strands.

11 Claims, 13 Drawing Sheets

ROPE AND FASTENER ASSEMBLY

CROSS-REFERENCE TO RELATED APPLICATIONS

This application claims the benefit of U.S. Provisional Application No. 61/382,288, entitled "Hanging Systems for Suspended Seating or Sleeping Structures, Such as Hammocks", which was filed on Sep. 13, 2010, and which is hereby incorporated herein in its entirety.

BACKGROUND

There has long been a need for quickly attaching ropes to, and detaching ropes from, objects of various shapes and sizes. In most cases, this is done using one of a variety of knots. However, tying and untying knots can be time consuming—especially in cases where a knot has become particularly tight due to loads placed on the knot. Accordingly, there is a need for improved methods and apparatus for facilitating the quick attachment of ropes to, and detachment of ropes from, objects of various sizes. This need is especially present in the context of ropes used to attach hammocks to trees and other structures.

SUMMARY

A rope assembly, according to various embodiments, comprises: (1) a braided rope comprising a plurality of braided strands; and (2) a rope fastener. In particular embodiments, the rope fastener is adapted to: (1) be attached to the braided rope adjacent a first end of the braided rope; (2) allow a user to selectively form a braided rope loop of a first particular circumference by fitting the rope fastener through the plurality of braided strands at a first particular location on the braided rope; and (3) allow a user to selectively form a braided rope loop of a second particular circumference by fitting the rope fastener through the plurality of braided strands at a second particular location on the braided rope. In various embodiments, the rope fastener is shaped for selectively preventing the rope fastener from returning through the plurality of braided strands of the braided rope after the rope fastener has been fitted through the plurality of braided strands.

A hammock assembly, according to various embodiments, comprises: (1) a hammock; (2) a braided rope comprising a plurality of braided strands, wherein the braided rope is adapted to be attached to the hammock adjacent a first end of the hammock; and (3) a rope fastener. In particular embodiments, the rope fastener is adapted: (1) to be attached to the braided rope adjacent a first end of the first braided rope, and to be selectively fitted through the plurality of braided strands at any of a plurality of locations on the braided rope; and (2) the rope fastener is shaped for selectively preventing the rope fastener from returning through the plurality of braided strands of the braided rope after the rope fastener has been fitted through the plurality of braided strands. In various embodiments, the braided rope is adapted to be selectively formed into a braided rope loop by: (1) fitting the rope fastener through the plurality of strands of the braided rope; and (2) securing the rope fastener in place adjacent the braided rope. In particular embodiments, the braided rope loop is adapted to support the first end of the hammock.

A method of hanging a hammock, according to various embodiments, comprises the steps of:

(A) providing a hammock and a braided rope, wherein the braided rope is adapted to be attached to the hammock adjacent a first end of the hammock, and the braided rope comprises: (1) a plurality of braided strands; and (2) a rope fastener that is adapted to be attached to the plurality of braided strands adjacent a first end of the plurality of braided strands, wherein: (a) the rope fastener is adapted to be selectively fitted through the plurality of braided strands; and (b) the rope fastener is shaped for selectively preventing the rope fastener from returning through the plurality of braided strands of the braided rope after the rope fastener has been fitted through the plurality of braided strands;

(B) after completing Step (A), above, wrapping the braided rope around a support object;

(C) after completing Step (B), above, threading an end of the braided rope with the rope fastener through a rope end loop and cinching the braid rope against the support object;

(D) after completing Step (C), above, threading the end of the braided rope with the rope fastener through a hammock loop on a first end of the hammock;

(E) after completing Step (D), above, fitting the rope fastener through the plurality of braided strands of the braided rope;

(F) after completing Step (E), above, securing the rope fastener to: (1) keep a first end of the braided rope between the plurality of braided strands, and (2) form a braided rope loop.

BRIEF DESCRIPTION OF THE FIGURES

Figure 1:
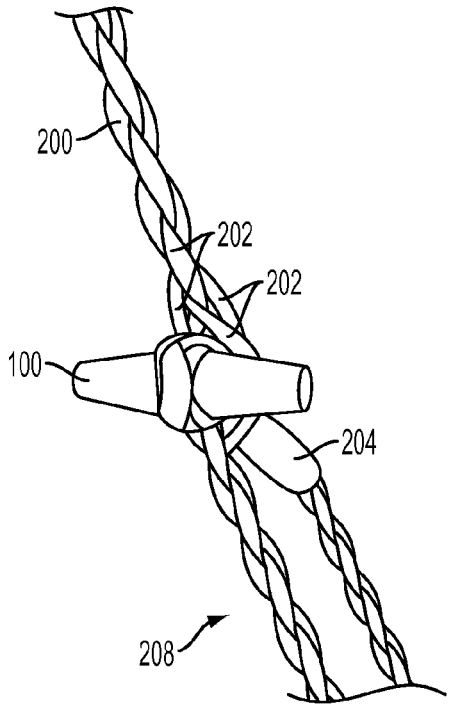

Having thus described various embodiments in general terms, reference will now be made to the accompanying drawings, which are not necessarily drawn to scale, and wherein:

FIG. 1 is a front perspective view of a braided rope and a rope fastener according to a particular embodiment of the invention.

Figure 2:
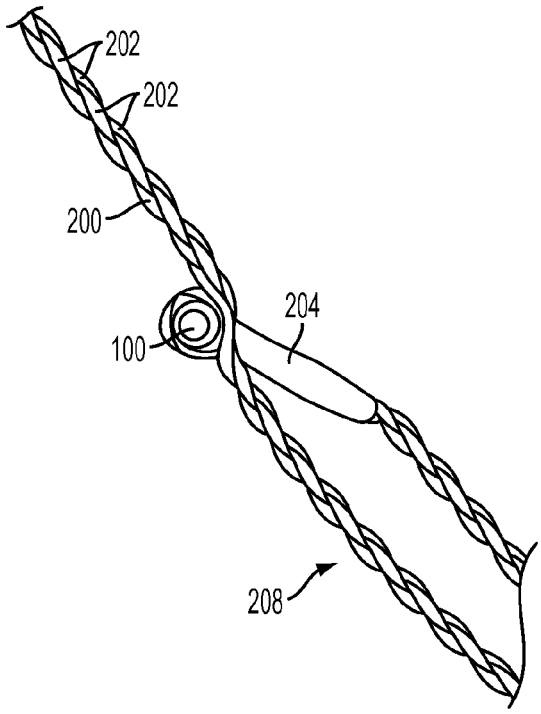

FIG. 2 is a side view of the braided rope and the rope fastener of FIG. 1.

Figure 3:
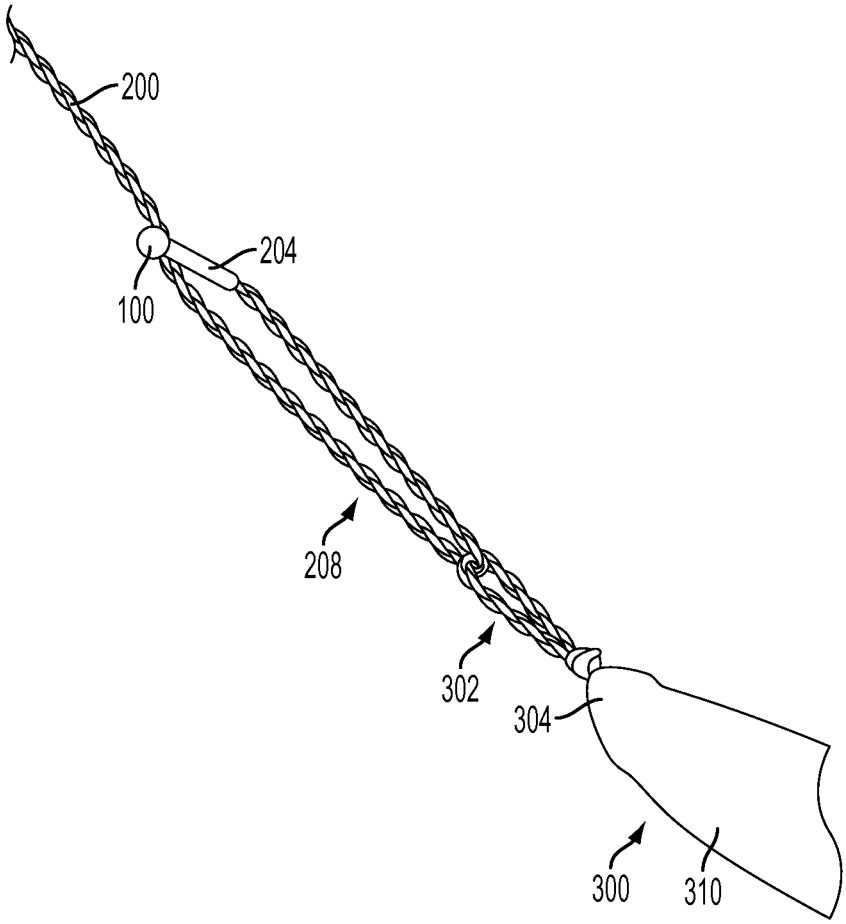

FIG. 3 is a side view of the braided rope and a rope fastener of FIG. 1, which are being used to support an end of a hammock.

Figure 4:
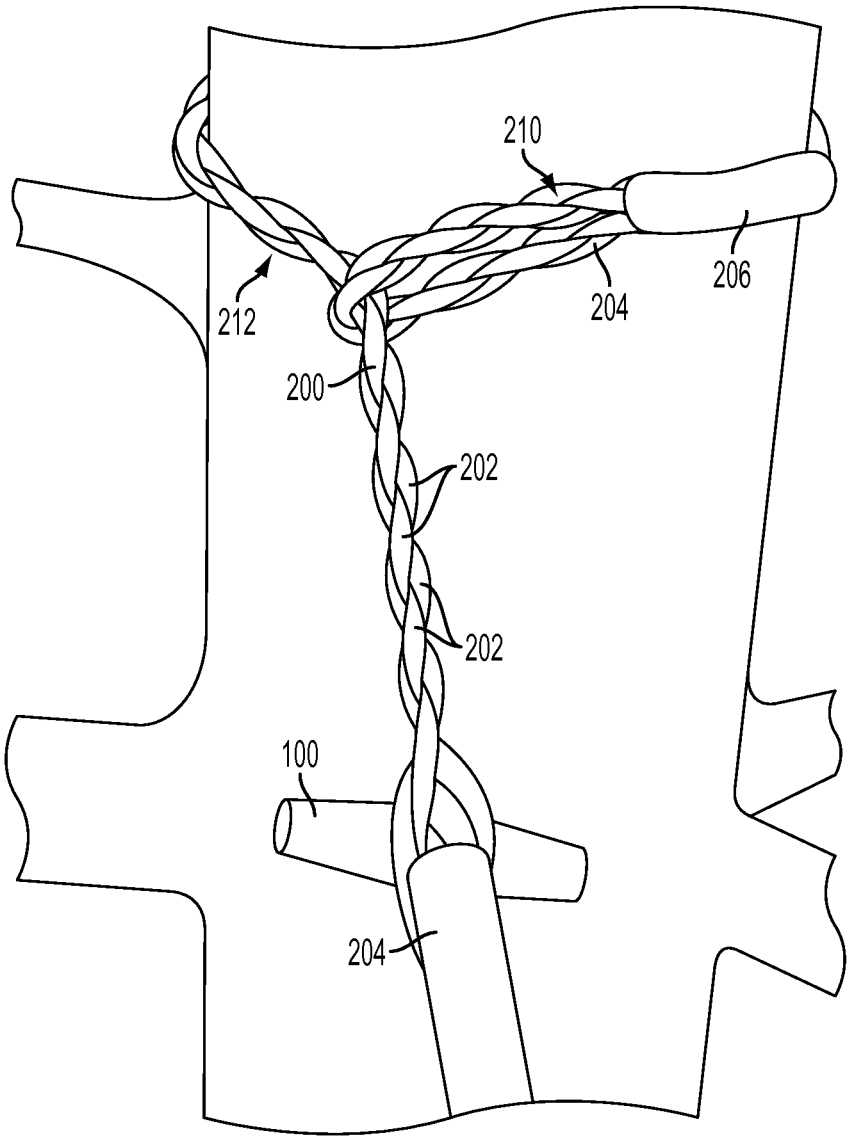

FIG. 4 is a top perspective view of a braided rope and a rope fastener according to a particular embodiment of the invention.

Figure 5:
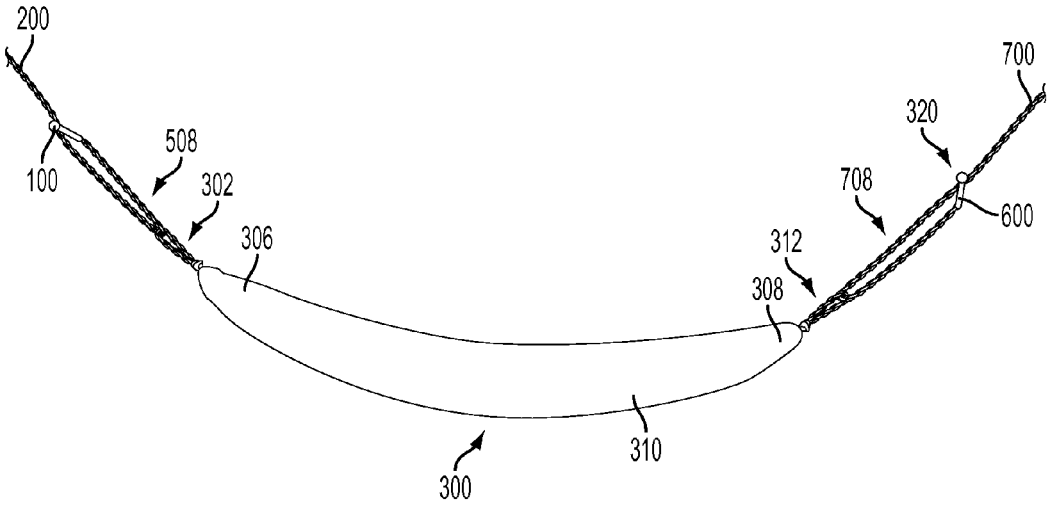

FIG. 5 is a side view of a hammock, a first braided rope, a first rope fastener, a second braided rope, and a second rope fastener according to a particular embodiment of the invention.

Figure 6:
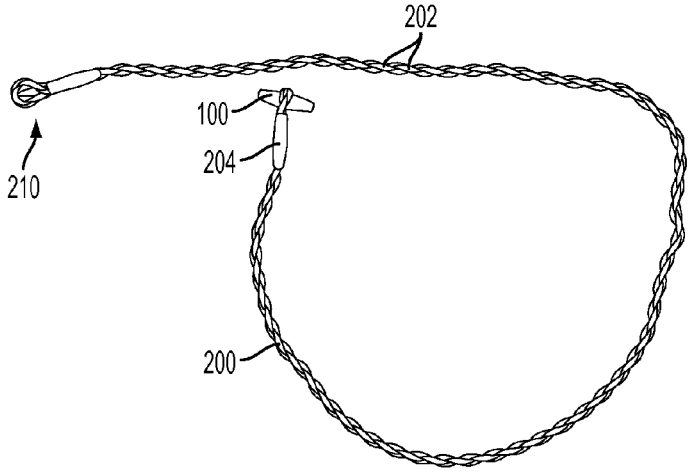

FIG. 6 is a top view of the braided rope and a rope fastener of FIG. 1.

Figure 7:
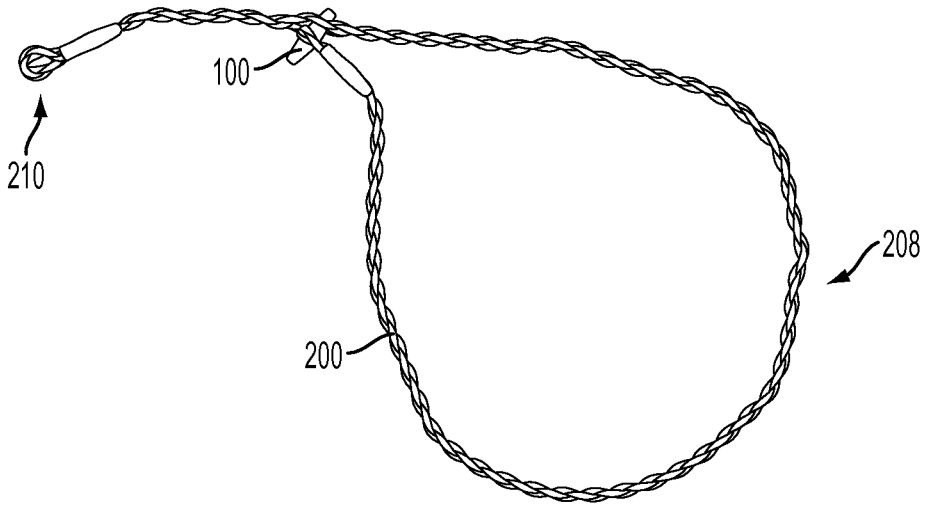
Figure 8:
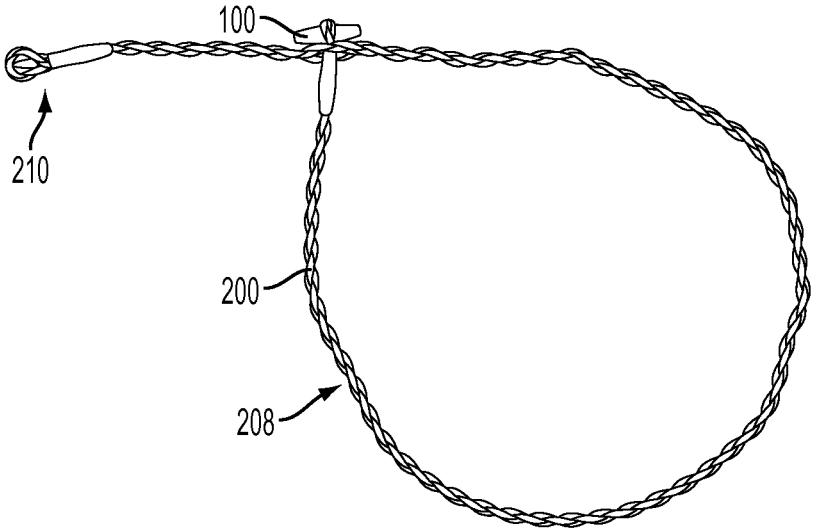
Figure 9:
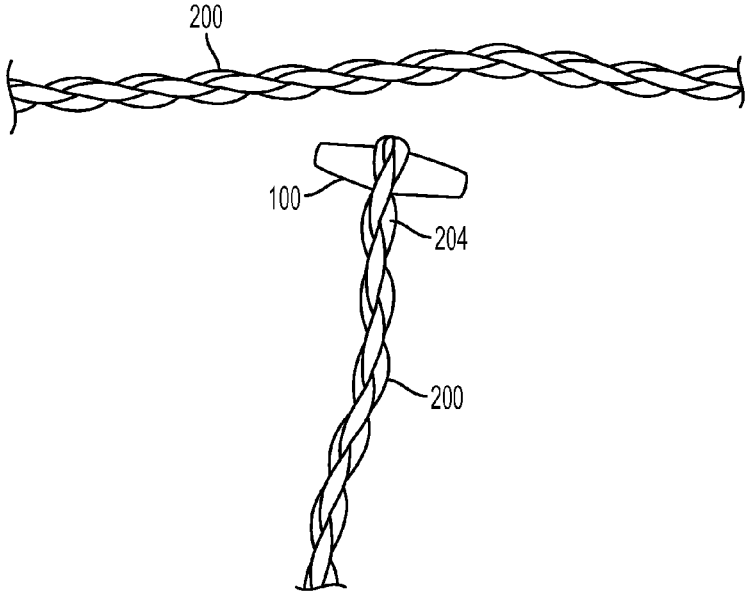

FIG. 7-8 are top views of the braided rope and a rope fastener of FIG. 1 in various sequential steps of forming a braided rope loop.

FIG. 9-13 are top views of the braided rope and a rope fastener of FIG. 1 in various sequential steps of fitting the rope fastener through a plurality of braided strands of the braided rope (an example of which shown FIG. 8).

FIG. 14-21 are top views of the braided rope of FIG. 1 in various sequential steps of forming a rope end loop.

Figure 22:
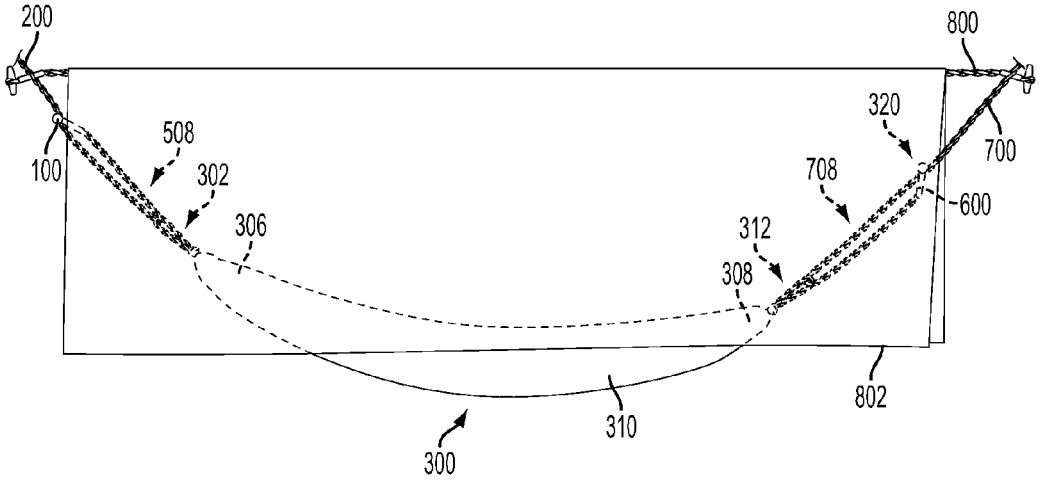

FIG. 22 is a side view of a pair of the braided rope and rope fasteners being used to support a hammock combined with a ridge rope supporting a hammock cover.

DETAILED DESCRIPTION OF VARIOUS EMBODIMENTS OF THE INVENTION

Various embodiments of the present invention will now be described more fully hereinafter with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Exemplary Hammock Assembly

FIG. 5 shows a hammock assembly according to a particular embodiment of the invention. In this embodiment, the hammock assembly includes the following components: (1) a hammock 300; (2) a braided rope 200; and (3) a rope fastener 100. As shown in FIG. 5, the hammock assembly may further comprise: (1) a second braided rope 700; and (2) a second rope fastener 600. Each of these components is discussed in further detail below.

Hammock

A hammock 300 according to a particular embodiment of the invention is shown in FIG. 5. As may be understood from this figure, in particular embodiments, the hammock 300 comprises a body support portion 310 (e.g., a single piece of fabric such as nylon or Cordura® Ripstop) that is adapted to support a user. In alternative embodiments, the body support portion 310 may comprise multiple pieces of fabric that are adapted to support the user. In further embodiments, the body support portion 310 may comprise netting or any other suitable material adapted to support the user.

As shown in FIG. 5, in particular embodiments, the hammock 300 may further comprises a hammock loop 302 attached to a first end 306 of the body support portion 310, this hammock loop 302 is adapted to support the body support portion 310 at the first end 306 of the body support portion 310 in conjunction with a braided rope 200 and a rope fastener 100 (these components are discussed in more detail below). The hammock loop 302 may comprise a rope, cable, ring (e.g., a metal or plastic ring), or any other suitable structure.

As shown in FIG. 5, in particular embodiments, the hammock 300 further comprises a second hammock loop 312 adapted to support the body support portion 310 at a second end 308 of the body support portion 310. This second hammock loop 312 functions and is comprised in a similar manner to the first hammock loop 302 described above. In a particular embodiment, the first hammock loop 302 and second hammock loop 312 may comprise different materials.

Braided Rope

A braided rope 200 according to a particular embodiment of the invention is shown in FIGS. 1-4 and 6-8. As may be understood from these figures, in particular embodiments, the braided rope 200 comprises a plurality of braided strands 202. As shown in FIGS. 1-4 and 6-8, in particular embodiments, the braided rope 200 may comprise a four strand round braided rope. In other embodiments, the braided rope 200 may comprise five, six, eight or any other suitable number of strands that are braided together to form the braided rope 200. In the embodiment shown in FIGS. 1-4 and 6-8, the various strands 202 that form the braided rope 200 are lengths of parachute cord. However, in other embodiments, the plurality of braided strands 202 may comprise any other suitable type of cord. As shown in FIGS. 1-4 and 6-8, in particular embodiments, the braided rope 200 is adapted to allow a rope fastener 100 (which is discussed further below) to fit between the plurality of braided strands 202 and through the braided rope 200.

Figure 14:
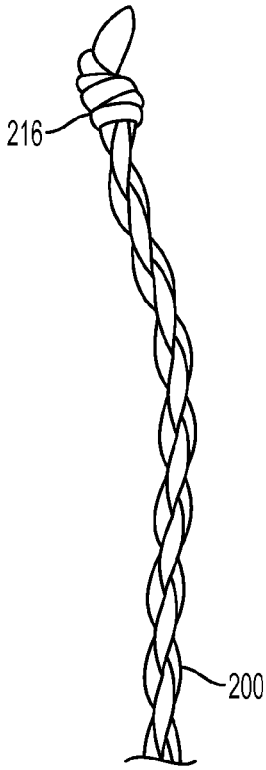
Figure 15:
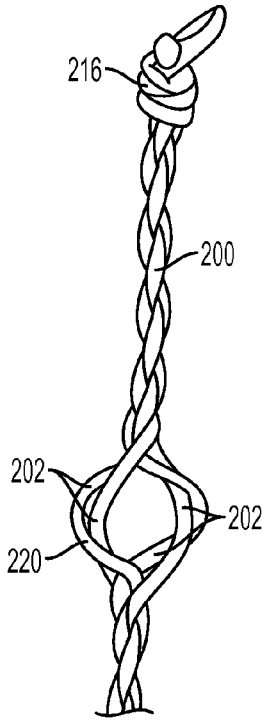
Figure 16:
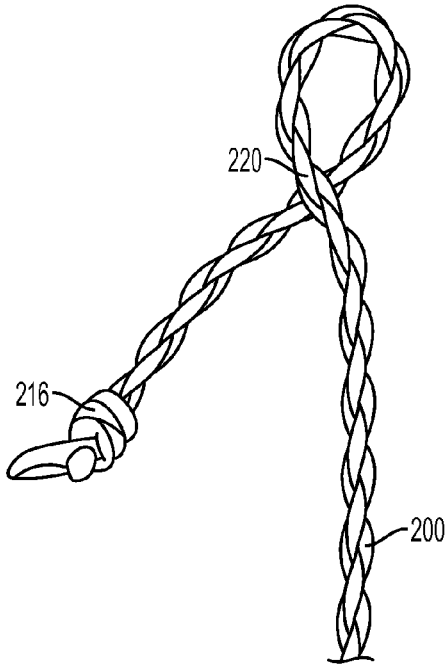
Figure 17:
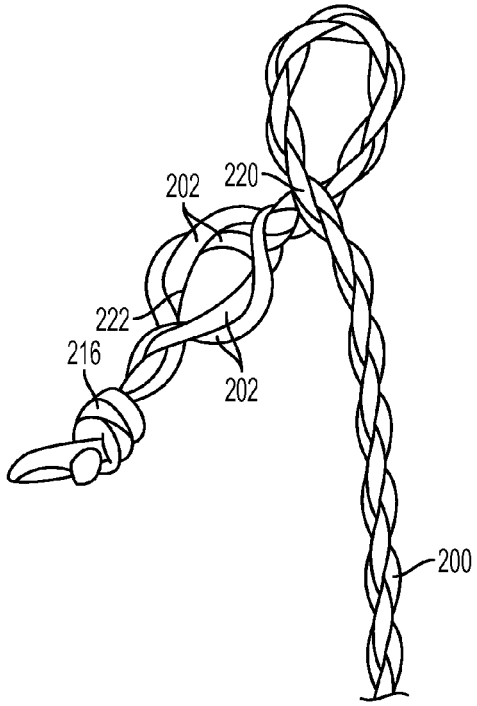
Figure 18:
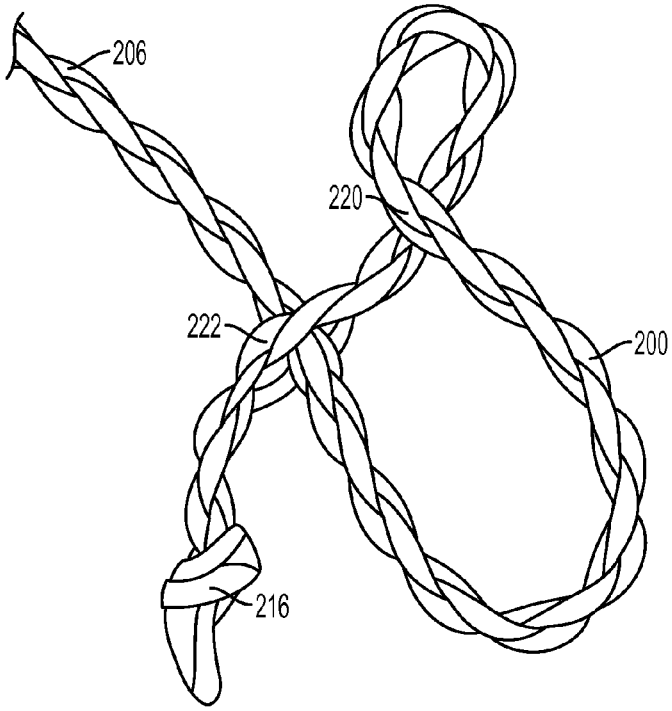
Figure 19:
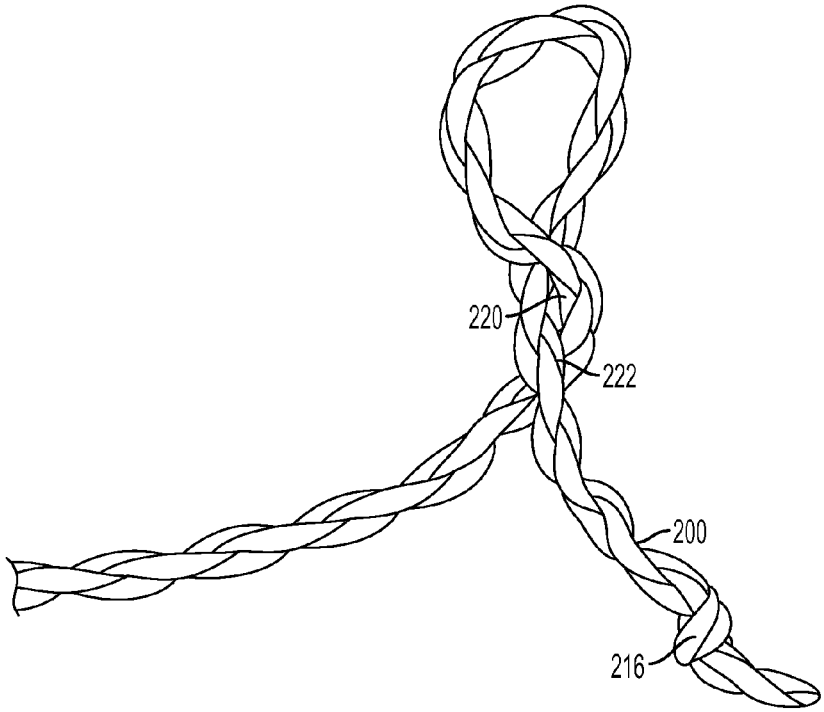
Figure 20:
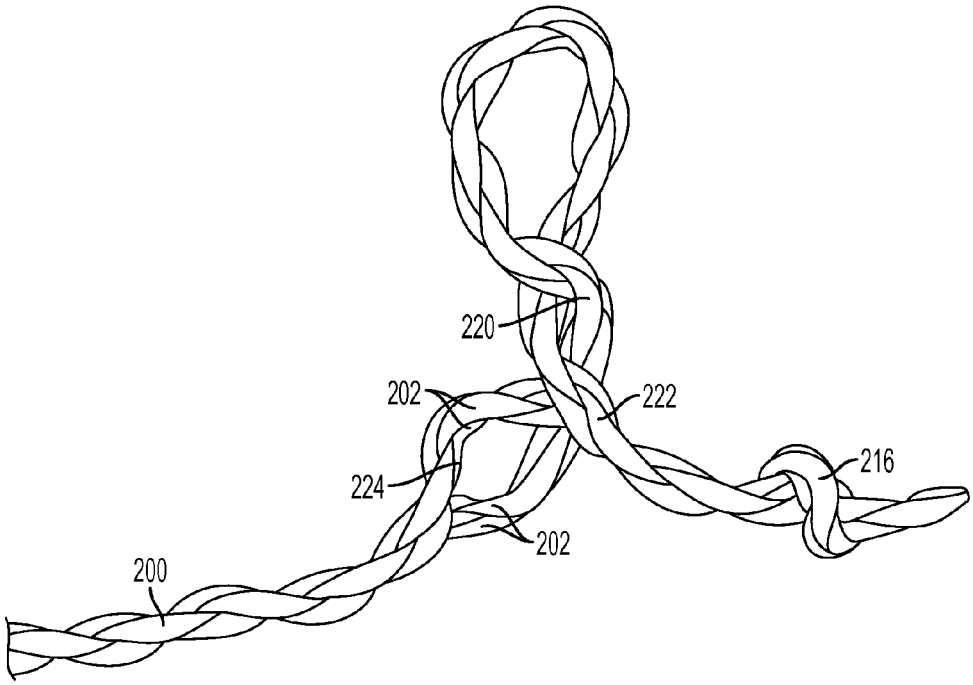
Figure 21:
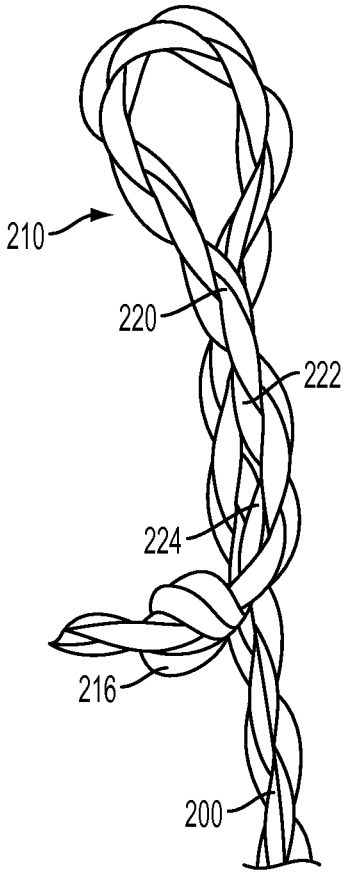

As shown in FIG. 6, in particular embodiments, the braided rope 200 may form or otherwise comprise a rope end loop 210 adjacent (e.g., at) a first end 204 of the braided rope 200. In specific embodiments, and as shown in FIGS. 14-21, this rope end loop 210 may be formed by the sequential steps of: (1) as shown in FIG. 14, forming a portion of braided rope 200 adjacent to the first end of the braided rope 204 into a large diameter rope segment 216 (e.g., knotting the rope to make the portion have a larger diameter than adjacent rope sections); (2) as shown in FIGS. 15 and 16, threading the first end of the large diameter rope segment 216 through the plurality of braided strands 202 of the braided rope 200 at a first particular point 220 along the length of the braided rope 200; (3) as shown in FIGS. 17 and 18, threading the second end of the braided rope 200 through the plurality of braided strands 202 of the braided rope 200 at a second particular point 222 on a portion of the braided rope 200 that was threaded through the plurality of braided strands 202 in Step 2 above; (4) as shown in FIGS. 20 and 21, threading the large diameter rope segment 216 (e.g., the knot at the end of the rope) through the plurality of braided strands 202 of the braided rope 200 at a third particular point 224 adjacent to the second particular point 222; and (5) securing the large diameter rope segment (e.g. fixing the large diameter rope segment to prevent it from returning through the plurality of strands). In further embodiments, the rope end loop 210 may be formed in any other suitable manner (e.g., by splicing, a knotting, fastening, tying or gluing the end of the rope to form a suitable loop).

Rope Fastener

Figure 10:
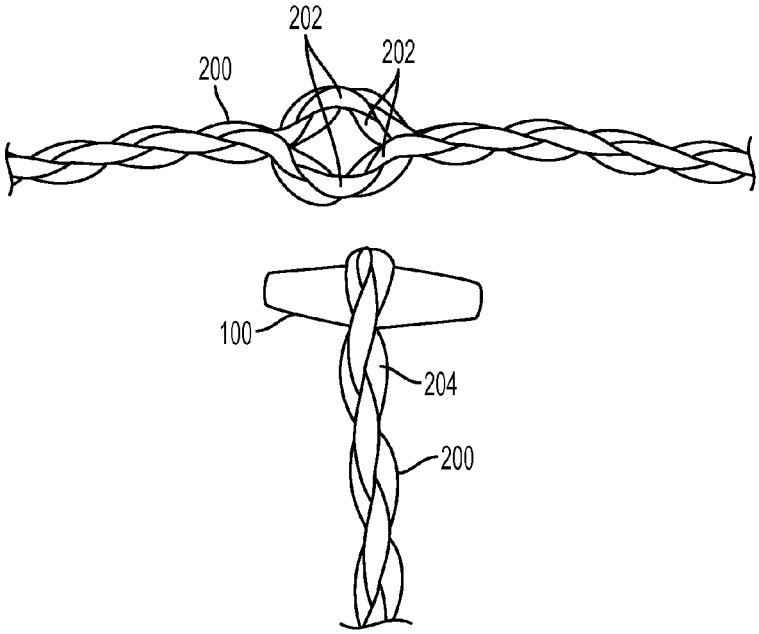

A rope fastener 100 according to a particular embodiment is shown in FIG. 10. As may be understood from this figure, in particular embodiments, the rope fastener 100 is adapted to be selectively fit between the plurality of braided strands 202 and through the braided rope 200. In particular embodiments, the rope fastener 100 may be fitted between at least two strands on either side of the rope fastener 100 to avoid pulling out a single strand out of the braided rope 200 after a load is placed on the braided rope 200. In particular embodiments, the rope fastener 100 is further adapted for selectively preventing the rope fastener 100 from returning through the plurality of braided strands 202 of the braided rope 200 after the rope fastener 100 has been fit through the plurality of braided strands 202.

As shown in FIG. 10, in particular embodiments, the rope fastener 100 comprises a toggle. In further embodiments, the rope fastener 100 may comprise a hook, a pin, a karabiner, or any other device adapted for selectively preventing the rope fastener 100 from returning through the plurality of braided strands 202 after the rope fastener 100 has been fit through the plurality of braided strands 202.

As shown in FIG. 10, in particular embodiments, the rope fastener 100 is adapted to be attached to the braided rope 200 adjacent (e.g., at) a first end 204 of the braided rope 200. In particular embodiments, the rope fastener 100 may be selectively attached to the braided rope 200 adjacent the first end 204 of the braided rope 200. In various embodiments, the rope fastener 100 may be incorporated into the braided rope 200 adjacent the first end 204 of the braided rope using the loop forming method described above. In other embodiments, the rope fastener 100 is incorporated into the braided rope 200 by a splice. In additional embodiments, the rope fastener 100 may be attached to the braided rope 200 in any other suitable manner, (e.g., in any suitable manner, such as through the use of glue or knots).

Supporting the Hammock

Various methods of supporting the hammock described above using the braided rope and rope fastener described above will now be discussed with reference to FIGS. 4-6 and 9-13.

Function of the Rope End Loop

As may be understood from FIGS. 4-6, in particular embodiments, an end of the hammock may be supported by wrapping the braided rope 200 around a support object, passing an end of the rope through the rope's rope end loop 210, and cinching the rope 200 to the support object in order to secure the rope 200 to the support object in the manner described below. In various embodiments, the braided rope loop 208 (described in greater detail below) may be adapted to extend through the hammock loop 302, shown in FIG. 5 to facilitate supporting the hammock 300).

Forming A Braided Rope Loop

A braided rope loop 208 according to a particular embodiment of the invention is shown in FIG. 6. As may be seen in FIGS. 9-13, in particular embodiments, the braided rope loop 208 may be formed by fitting the rope fastener 100 through the plurality of braided strands 202 of the braided rope 200 and securing the rope fastener 100 to prevent the rope fastener 100 from returning through the plurality of braided strands 202. As may be understood from FIG. 5, to support the hammock 300, the braided rope loop 208 may enclose the hammock loop 302. In various embodiments, the rope end loop 210 may encircle the support object to support the hammock 300 or may be adapted to form a support loop 212 that encircles the support object (this support loop is described further below). In further embodiments, the braided rope loop 208 may be adapted to support the hammock 300 by securing the braided rope loop 208 to a support object such as a tree, post, or hook (e.g. by wrapping or forming the loop around the support object or using the loop to cinch the braided rope 200 to the support object).

In particular embodiments, the rope fastener 100 is adapted for fitting through the plurality of braided strands 202 of the braided rope 200 at any of a plurality of locations on the braided rope 200. Fitting the rope fastener 100 through the plurality of braided strands 202 at a first particular point on the braided rope 200 creates a braided rope loop 208 with a first particular circumference. Fitting the rope fastener 100 through the plurality of braided strands 202 at a second particular point on the braided rope 200 creates a braided rope loop 208 with a second particular circumference. The braided rope loop 208 may set to a desired circumference (within the length of the braided rope 200) by selecting the particular point on the braided rope 200 associated with the desired circumference and fitting the rope fastener 100 through the plurality of braided strands 202 at the particular point on the braided rope 200 associated with the desired circumference.

Exemplary Rope Assembly For Hanging A Hammock

The braided rope 200 and rope fastener 100 combination described above may, for example, be adapted to support any suitable hammock. A braided rope and rope fastener combination may be sold as a kit to retrofit any existing hammock for easy hanging. A retrofit kit may comprise, for example, at least one braided rope 200 and at least one rope fastener 100. The braided rope and rope fastener combination of the retrofit kit may comprise any of the embodiments for braided rope 200 and rope fasteners 100 described above.

Method of Hanging A Hammock

Turning to FIGS. 5 and 6, in a particular embodiment, a method of hanging a hammock comprises the following steps: (1) providing a hammock 300 and a braided rope 200 comprising a plurality of braided strands 202 and a rope fastener 100; (2) wrapping the rope fastener end of the braided rope 200 (e.g. the end of the braided rope 200 with the rope fastener 100) around a support object; (3) fitting the rope fastener end of the braided rope 200 through a rope end loop 210 and cinching the braided rope 200 tight against the support object; (4) fitting the rope fastener end of the braided rope 200 through a hammock loop 302; (5) fitting the rope fastener 100 through the plurality of braided strands 202 of the braided rope 200; and (6) after fitting the rope fastener 100 through the plurality of braided stands 202, securing the rope fastener 100 to form a braided rope loop 208. Each of the above steps is discussed in greater detail below.

In a particular embodiment, in the first step of the method, a user provides a hammock and braided rope. The hammock 300 may, for example, comprise any of the hammock embodiments described above. The braided rope 200 may, for example, comprise any of the braided rope embodiments described above.

Figure 11:
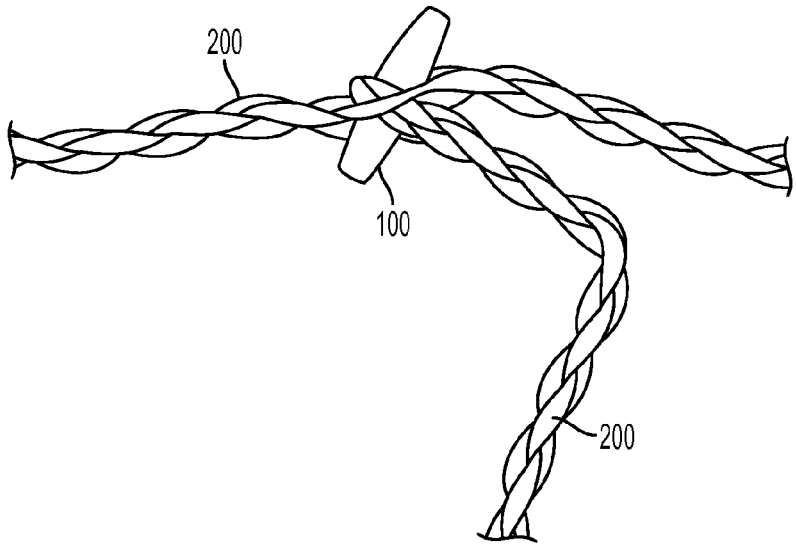
Figure 12:
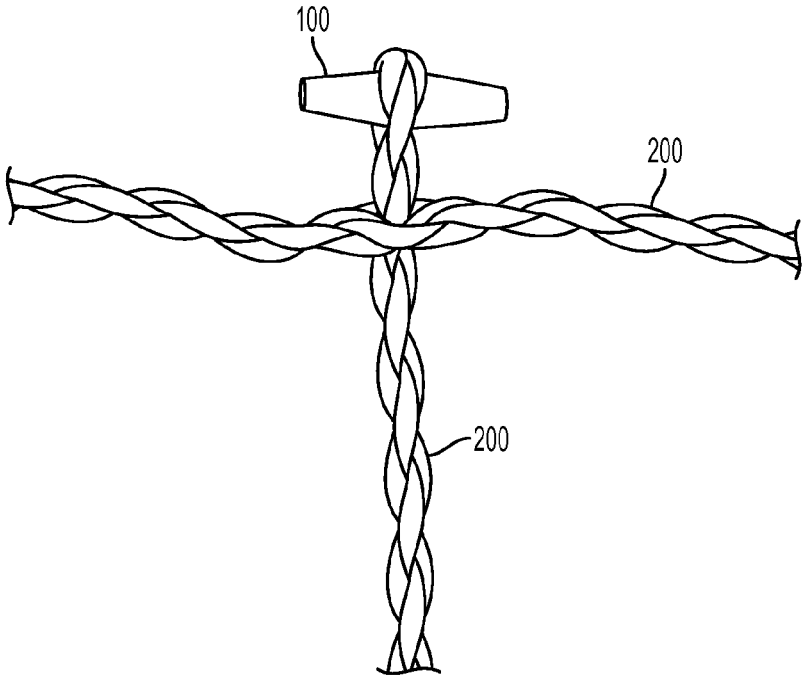

To hang a hammock 300 using the components described generally above, a user first wraps the rope fastener end of the braided rope 200 around the support object. After this step, the user fits the rope fastener end of the braided rope 200 through the braided rope's rope end loop 210 and cinches the braided rope 200 to the support object in order to secure the braided rope to the support object. Next, the user threads the rope fastener end of the braided rope 200 through a hammock loop 302 that is adjacent to a first end 306 of the body support portion 310 of the hammock 300. Then, the user fits the rope fastener 100 through the plurality of braided strands 202 of the braided rope 200. The user may insert the fastener 100 between the plurality of braided strands 202 as shown in FIG. 11. Next, the user may move the fastener 100 through the plurality of braided strands 202 as shown in FIG. 12. As may be seen in FIG. 12, during this step, the leading end of the braided rope 200 (e.g. the end of the braided rope 200 with the rope fastener 100) is also brought through the plurality of braided strands 202 because the plurality of braided strands 202 is attached to the rope fastener 100.

Figure 13:
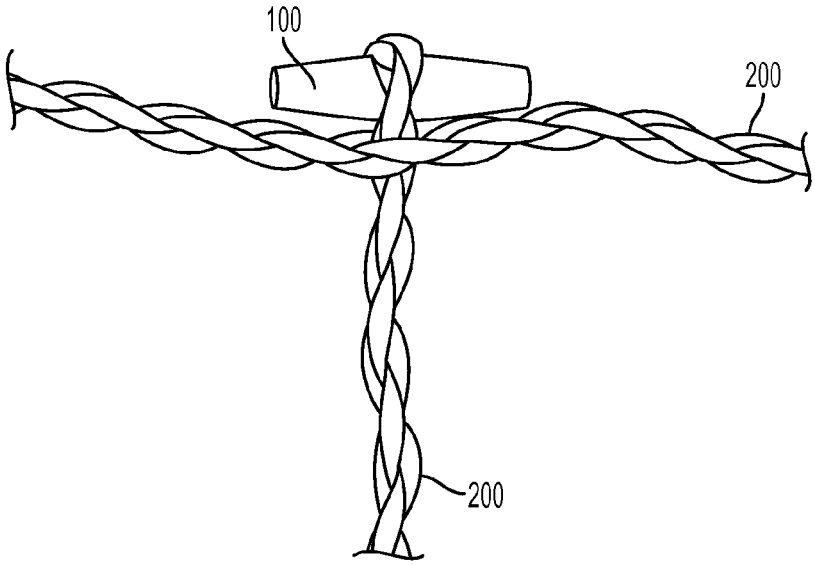

After the rope fastener 100 has been fitted through the plurality of braided strands 202, the user secures the rope fastener 100 in place adjacent the braided rope 200. The user may adjust or place the rope fastener 100 in a particular position to keep the rope fastener 100 fixed in a manner as shown in FIG. 13 (e.g. by turning the rope fastener parallel to the braided rope 200). The step of securing the rope fastener 100 keeps a first end of the braided rope 204 between the plurality of braided strands 202 and forms the braided rope loop 208. In particular embodiments, the user may selectively adjust the circumference of the braided rope loop 208 in the manner described above (e.g. by selecting another point on the braided rope 200 corresponding to an approximate diameter and then repositioning the first end of the braided rope 204 and the rope fastener 100 so that the rope fastener 100 extends through, and is positioned adjacent, the new point on the braided rope 200).

After securing the rope fastener to form the braided rope loop 208, the end of the hammock 300 is supported. In alternative embodiments, the user may use the braided rope loop 208 to cinch the braided rope 200 to the support object and cinch the rope end loop 210 to the hammock loop 302.

Additional Steps: A Second Braided Rope

In further embodiments, the step of providing a hammock 300 and a braided rope 200 may further comprise providing a second braided rope 700 in substantially the same manner as described above where the second braided rope 700 is attached to a second end of the body support portion 310 of the hammock 300 (the second braided rope 700 is discussed further below). This second braided rope 700 may be used to support a second end 308 of body support portion 310 of the hammock 300 in substantially the same manner as the braided rope described above.

Additional Structural Components

Hammock End Support

A hammock end support 320 according to a particular embodiment of the invention is shown in FIG. 5. As may be understood from this figure, in particular embodiments, the hammock end support 320 is adapted to support the second end 308 of the body support portion 310 of the hammock 300. The hammock end support 320 may be, for example, a suitable rope assembly, a chain, a cable, a hook, a post, or a tree. As shown in FIG. 5, in particular embodiments, the hammock assembly may comprise, as a hammock end support 320, a second braided rope 700 and a second rope fastener 600. This second braided rope 700 and second rope fastener 600 function and are respectively comprised in a similar manner to the braided rope 200 and rope fastener 100 described above.

Tarp Support

In particular embodiments, the braided rope and rope fastener of FIG. 6 (or variations thereof) may also be used, as part of the hammock assembly, to support various tent components, such as tarps. For example, the hammock assembly may include a ridge rope that comprises a single strand of parachute cord, and two toggles (one attached to each end of the parachute cord). One end of this ridge rope may be attached to any braided rope of the hammock assembly by passing one of the ridge rope's toggles through the braided rope and securing the toggle in place adjacent the braided rope as described above. The other end of the ridge rope may be attached (e.g., while the ridge rope is in tension) to another braided rope (e.g., that is part of the hammock assembly) in a similar manner. A tarp may then be hung over the ridge rope to provide shelter for objects below. For example, the ridge rope may extend over the hammock and the tarp may provide a cover for the hammock.

It should be understood that, in various embodiments, the ridge rope described above may comprise a rope with a plurality of strands (e.g., two or more strands of parachute chord). This may provide additional options for allowing the user to attach the ridge rope to fixed objects and other ropes as described above. It should also be understood that the ridge rope's various strands may comprise any suitable material and that one or more of the ridge rope's toggles may be replaced, for example, with: (1) another suitable type of fastener; (2) a rope end loop; and/or (3) a ring.

Conclusion

Many modifications and other embodiments of the invention will come to mind to one skilled in the art to which this invention pertains having the benefit of the teachings presented in the foregoing descriptions and the associated drawings. For example, while the various structures (e.g., rope assemblies) described herein are described in regard to hanging hammocks, the same or similar techniques may be used to support suspended seating structures such as "Air Chairs". Also, while various rope assemblies are described herein as having a toggle attached to one end of a braided rope and a ring formed in another end of the braided rope, it should be understood that other rope assemblies may include, for example: (1) a toggle, or other fastener, attached adjacent (e.g., to) each end of the braided rope; (2) a ring attached adjacent (e.g., to) each end of the braided rope; or (3) a rope end loop formed adjacent (e.g., at) each end of the braided rope. Accordingly, as will be understood by one skilled in the relevant field in light of this disclosure, the invention may take form in a variety of different mechanical and operational configurations. Therefore, it is to be understood that the invention is not to be limited to the specific embodiments disclosed and that modifications and other embodiments are intended to be included within the scope of the appended exemplary concepts. Although specific terms are employed herein, they are used in a generic and descriptive sense only and not for the purposes of limitation.

What is claimed is:

1. A hammock assembly, comprising:

a hammock;

a braided rope comprising a plurality of braided strands, wherein said braided rope is adapted to be attached to said hammock adjacent a first end of said hammock;

a rope fastener, wherein:

said rope fastener is adapted to be attached to said braided rope adjacent a first end of said first braided rope;

said rope fastener is adapted to be selectively fitted through said plurality of braided strands at any of a plurality of locations on said braided rope; and said rope fastener is shaped for selectively preventing said rope fastener from returning through said plurality of braided strands of said braided rope after said rope fastener has been fitted through said plurality of braided strands; wherein:

said braided rope is adapted to be selectively formed into a braided rope loop by fitting said rope fastener through said plurality of strands of said braided rope and securing said rope fastener; and said braided rope loop is adapted to support said first end of said hammock.

2. The hammock assembly of claim 1, wherein said rope fastener comprises a toggle.

3. The hammock assembly of claim 1, wherein said rope fastener comprises a hook.

4. The hammock assembly of claim 1, wherein said braided rope comprises a four strand round braided rope.

5. The hammock assembly of claim 1, wherein said braided rope loop is adapted to be selectively sized to a particular circumference by fitting said rope fastener through said plurality of strands at a particular one of said plurality of locations on said braided rope corresponding to said particular circumference.

6. The hammock assembly of claim 1, wherein, said braided rope is a first braided rope, said plurality of braided strands is a first plurality of braided strands, said rope fastener is a first rope fastener, said braided rope loop is a first braided rope loop, and said second hammock end support comprises:

a second braided rope comprising a second plurality of braided strands, wherein said second braided rope is adapted to be attached to said hammock adjacent said second end of said hammock; and a second rope fastener, wherein:

said second rope fastener is adapted to be attached to said second braided rope adjacent a first end of said second braided rope;

said second rope fastener is adapted to be selectively fitted through said second plurality of braided strands at any of a plurality of locations on said second braided rope; and said second rope fastener is shaped for selectively preventing said second rope fastener from returning through said second plurality of braided strands of said second braided rope after said second rope fastener has been fitted through said second plurality of braided strands; wherein:

said second braided rope is adapted to be selectively formed into a second braided rope loop by fitting said second rope fastener through said second plurality of strands of said second braided rope and securing said second rope fastener; and said second braided rope loop is adapted to support said second end of said hammock.

7. The hammock assembly of claim 6, further comprising:

a ridge rope;

a first ridge rope fastener attached to said ridge rope adjacent a first end of said ridge rope; and a second ridge rope fastener attached to said ridge rope adjacent a second end of said ridge rope, wherein:

said first ridge rope fastener is adapted to be selectively fitted through said first plurality of braided strands at any of a plurality of locations on said first braided rope;

said first ridge rope fastener is shaped for selectively preventing said first ridge rope fastener from returning through said first plurality of braided strands of said first braided rope after said first ridge rope fastener has been fitted through said first plurality of braided strands;

said second ridge rope fastener is adapted to be selectively fitted through said second plurality of braided strands at any of a plurality of locations on said second braided rope;

said second ridge rope fastener is shaped for selectively preventing said second ridge rope fastener from returning through said second plurality of braided strands of said second braided rope after said second ridge rope fastener has been fitted through said second plurality of braided strands; and said ridge rope is adapted to be placed in tension and, at least in part, support a hammock cover after said first ridge rope fastener has been fitted through said first plurality of braided strands and said second ridge rope fastener has been fitted through said second plurality of braided strands.

8. A rope assembly comprising:

a braided rope comprising a plurality of braided strands; and a rope fastener, wherein:

said rope fastener is adapted to be attached to said braided rope adjacent a first end of said braided rope;

said rope fastener is adapted to allow a user to selectively form a braided rope loop of a first particular circumference by fitting said rope fastener through said plurality of braided strands at a first particular location on said braided rope;

said rope fastener is adapted to allow a user to selectively form a braided rope loop of a second particular circumference by fitting said rope fastener through said plurality of braided strands at a second particular location on said braided rope;

said rope fastener is shaped for selectively preventing said rope fastener from returning through said plurality of braided strands of said braided rope after said rope fastener has been fitted through said plurality of braided strands; and said braided rope comprises a four strand round braided rope.

9. A rope assembly comprising:

a braided rope comprising a plurality of braided strands; and a rope fastener, wherein:

said rope fastener is adapted to be attached to said braided rope adiacent a first end of said braided rope;

said rope fastener is adapted to allow a user to selectively form a braided rope loop of a first particular circumference by fitting said rope fastener through said plurality of braided strands at a first particular location on said braided rope;

said rope fastener is adapted to allow a user to selectively form a braided rope loop of a second particular circumference by fitting said rope fastener through said plurality of braided strands at a second particular location on said braided rope;

said rope fastener is shaped for selectively preventing said rope fastener from returning through said plurality of braided strands of said braided rope after said rope fastener has been fitted through said plurality of braided strands; and said braided rope comprises a six strand round braided rope.

10. A method of hanging a hammock comprising the steps of:

(A) providing a hammock and a braided rope, wherein said braided rope is adapted to be attached to said hammock adjacent a first end of said hammock, and said braided rope comprises:

(1) a plurality of braided strands; and (2) a rope fastener adapted to be attached to said plurality of braided strands adjacent a first end of said plurality of braided strands, wherein:

said rope fastener is adapted to be selectively fitted through said plurality of braided strands; and said rope fastener is shaped for selectively preventing said rope fastener from returning through said plurality of braided strands of said braided rope after said rope fastener has been fitted through said plurality of braided strands;

(B) after completing said Step (A), wrapping said braided rope around a support object;

(C) after completing said Step (B), threading an end of said braided rope with said rope fastener through a rope end loop and cinching said braid rope against said support object;

(D) after completing said Step (C), threading said end of said braided rope with said rope fastener through a hammock loop on a first end of said hammock;

(E) after completing said Step (D), fitting said rope fastener through said plurality of braided strands of said braided rope;

(F) after completing said Step (E), securing said rope fastener to: (1) keep a first end of said braided rope between said plurality of braided strands; and (2) form a braided rope loop.

11. The method of hanging a hammock of claim 10, wherein, said rope fastener is adapted to be selectively fitted through said plurality of braided strands at any of a plurality of locations on said braided rope, and further comprising the steps of:

(G) prior to said Step (E), determining at least an approximate rope loop circumference, wherein said approximate rope loop circumference corresponds to a required circumference needed to attach said braided rope loop to said support object;

(H) after said Step (G) and prior to said Step (E), at least partially in response to determining said approximate rope loop circumference, selecting a particular one of said plurality of locations on said braided rope, wherein said particular one of said plurality of locations is at least partially selected to substantially match said approximate rope loop circumference and a circumference of said braided rope loop, and wherein:

said Step (E) further comprises fitting said rope fastener through said plurality of braided strands of said braided rope at said particular one of said plurality of locations.

* * * * *